US012650056B2

(12) United States Patent
El Mallawany

(10) Patent No.: US 12,650,056 B2
(45) Date of Patent: Jun. 9, 2026

(54) PIEZOELECTRIC PUMP FOR WELLBORE TOOL

(71) Applicant: Halliburton Energy Services, Inc., Houston, TX (US)

(72) Inventor: Ibrahim El Mallawany, Al Khobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/591,649

(22) Filed: Feb. 29, 2024

(65) Prior Publication Data

US 2025/0277427 A1 Sep. 4, 2025

(51) Int. Cl.
*E21B 34/06* (2006.01)
*E21B 34/10* (2006.01)

(52) U.S. Cl.
CPC ..... *E21B 34/066* (2013.01); *E21B 34/10* (2013.01)

(58) Field of Classification Search
CPC ..... E21B 34/066; E21B 34/10
USPC ..... 166/373
See application file for complete search history.

(56) References Cited

U.S. PATENT DOCUMENTS

| | | | | |
|---|---|---|---|---|
| 7,484,940 | B2 | 2/2009 | Oneill | |
| 8,220,533 | B2 | 7/2012 | Longfield et al. | |
| 11,248,441 | B2 | 2/2022 | Vick, Jr. et al. | |
| 11,274,526 | B2 | 3/2022 | Deville et al. | |
| 11,643,905 | B2 | 5/2023 | Vick, Jr. et al. | |
| 11,773,687 | B2 * | 10/2023 | Minassa | E21B 23/04 137/596 |
| 11,905,790 | B2 * | 2/2024 | Chouzenoux | E21B 34/14 |
| 2010/0012313 | A1 * | 1/2010 | Longfield | F16K 31/006 417/322 |
| 2011/0302911 | A1 * | 12/2011 | Coonrod | F04B 17/003 60/420 |
| 2015/0292497 | A1 | 10/2015 | Van Es et al. | |
| 2018/0016865 | A1 | 1/2018 | El Mallawany | |
| 2018/0156015 | A1 | 6/2018 | Ding et al. | |
| 2020/0270965 | A1 | 8/2020 | Vick, Jr. et al. | |
| 2021/0215020 | A1 * | 7/2021 | Deville | E21B 23/04 |
| 2022/0381141 | A1 * | 12/2022 | Minassa | E21B 47/13 |

OTHER PUBLICATIONS

International Patent Application No. PCT/US2024/017838, International Search Report and Written Opinion mailed Nov. 19, 2024, 12 pages.

* cited by examiner

*Primary Examiner* — Tara Schimpf
*Assistant Examiner* — Patrick F Lambe
(74) *Attorney, Agent, or Firm* — Kilpatrick Townsend & Stockton LLP

(57) ABSTRACT

A system can be used to control a wellbore tool using a piezoelectric pump. The system can include a piston, the piezoelectric pump, and a solenoid valve. The piston can be positioned in a wellbore to control the wellbore tool. The piezoelectric pump can be coupled with the piston to generate differential pressure. The piston can be actuated in at least a first direction or a second direction in response to receiving the differential pressure. The solenoid valve can be coupled with the piezoelectric pump to selectively cause the piezoelectric pump to apply the differential pressure in the first direction or in the second direction.

25 Claims, 9 Drawing Sheets

PIEZOELECTRIC PUMP FOR WELLBORE TOOL

TECHNICAL FIELD

The present disclosure relates generally to wellbore operations and, more particularly (although not necessarily exclusively), to a piezoelectric pump that can be used to control one or more wellbore tools.

BACKGROUND

Wellbore operations may include various equipment, components, methods, or techniques to perform various tasks with respect to a wellbore. In some examples, wellbore tools, or wellbore tools, may be used to perform the wellbore operations. For example, the wellbore tools can be used to actuate downhole equipment, to test downhole equipment, and the like. In some cases, it can be difficult to precisely control the wellbore tools or downhole equipment without an excessive amount of electronics or other equipment positioned downhole.

DETAILED DESCRIPTION

Figure 1:
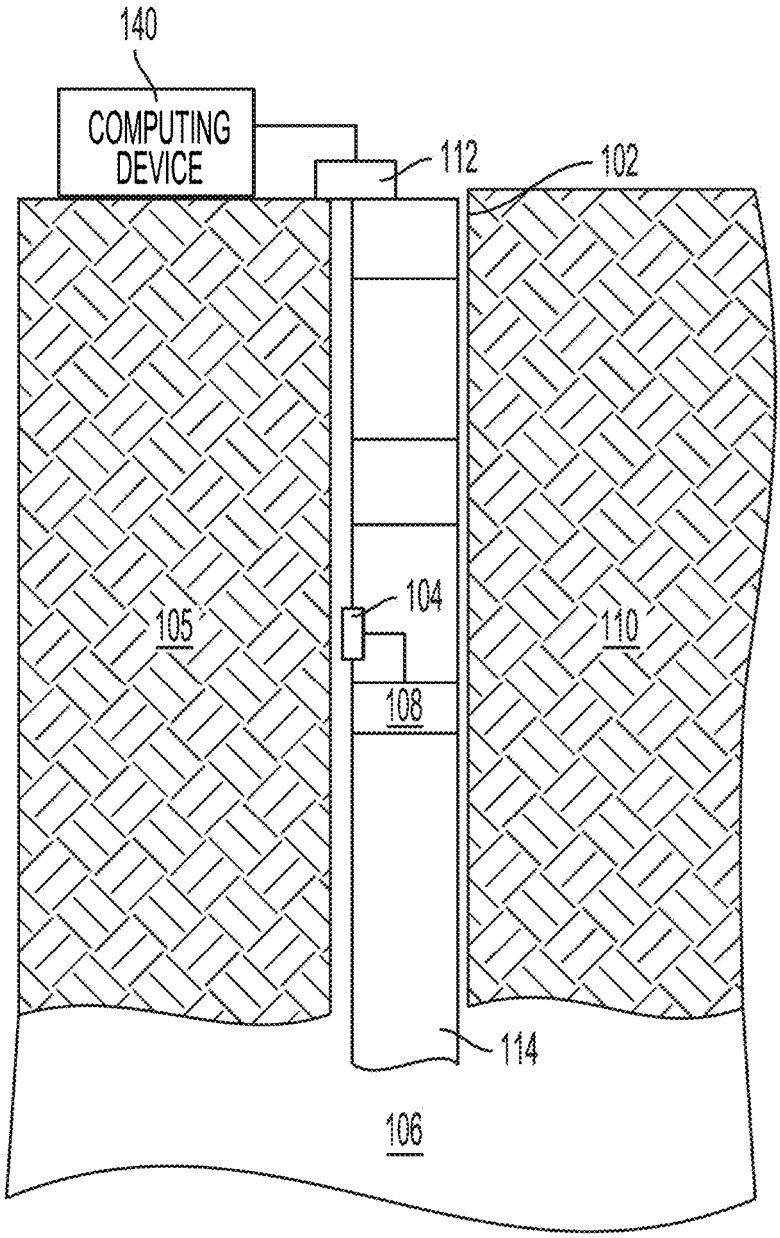
FIG. 1 is a sectional view of a wellbore that can use a piezoelectric pump to control a wellbore tool according to one example of the present disclosure.

Certain aspects and examples of the present disclosure relate to a system that uses a piezoelectric pump to control one or more wellbore tools. The one or more wellbore tools can include a safety valve, an inflow control valve, other suitable wellbore tools, or any combination thereof. The one or more wellbore tools can facilitate one or more wellbore operations such as a completion operation, a production operation, or the like. The piezoelectric pump may be or include one or more piezoelectric stacks that, when exposed to alternating current, can actuate or otherwise deform. The piezoelectric pump can be used to pump at least a portion of hydraulic fluid within the system to cause differential pressure to build on a piston. The differential pressure on the piston can cause the piston to stroke or displace in at least one direction to cause the one or more wellbore tools to actuate. Actuating the one or more wellbore tools can facilitate control of the one or more wellbore operations.

Electric completion systems can be used in a wellbore. One challenge for achieving electric completion systems may relate to downhole motors. For example, the downhole motors may be brushless designs that use electronics, which may occupy a lot of space and reduce reliability, downhole or may be brushed designs that have a limited life due to wear of the brushes. Additionally or alternatively, the electric completion system can include a safety valve. But, other completion systems may use excessive amounts of downhole electronics to control the safety valve. The safety valve can be actuated or locked in an open position electrically such that, when the power is lost, a retraction device, such as a spring, can immediately close the valve. Minimizing the use of electronics downhole can increase an available space to perform one or more wellbore operations.

A piezoelectric pump can be used to control the safety valve, other wellbore tools, or a combination thereof while minimizing electronics downhole. In some examples, the piezoelectric pump, which may be or include one or more piezoelectric stacks, can reciprocate at high frequency and can pump a fluid that can be used to stroke a piston to open the safety valve. In such examples, a solenoid valve can be turned on with the piezoelectric pump to allow a pressure differential to build across the piston. When the power is turned off, the solenoid valve can equalize the pressure across the piston, which can allow a retraction device, such as a spring, to close the safety valve. Additionally or alternatively, the piezoelectric pump can be used to stroke the piston in more than one direction. For example, the one or more piezoelectric stacks can reciprocate at high frequency and pump the fluid to stroke the piston to open a valve and to close the valve. The solenoid valve can be used to control a direction of applied pressure from the piezoelectric pump to cause the valve to open or to close.

In some examples, the piezoelectric pump may use few or no electronics downhole. In a particular example, electricity may be applied to the piezoelectric pump from uphole via an electricity transfer line, and the piezoelectric pump may be coupled with the solenoid valve. But, the piezoelectric pump may not be coupled with other downhole electronics. In other examples, the piezoelectric pump may be directly or indirectly coupled with limited numbers of downhole electronics such as a diode. Additionally or alternatively, a reliability of the piezoelectric pump may be higher than a second reliability of other downhole actuators that use excessive amounts of electronics.

A system can be used to control a safety valve, an inflow control valve (ICV), and other suitable wellbore tools or components. The system can include a piston, the piezoelectric pump, the solenoid valve, a retraction device (e.g., a spring, a second hydraulic line, etc.), and other suitable components. In examples involving the safety valve, and when the system is powered off, the solenoid valve can equalize a pressure between a hydraulic supply line and a hydraulic return line, which can allow the piston to move freely. In this example, the retraction device can contact a tubing coupled to the safety valve to displace the tubing to close the safety valve. To open the safety valve, power can be supplied to the piezoelectric pump and the solenoid valve. The solenoid valve can prevent communication between the hydraulic supply line and the hydraulic return line, which can allow a pressure differential to build. The piezoelectric pump can be reciprocated by varying the voltage on the piezoelectric pump at high frequency and can act as a positive displacement pump. The piezoelectric pump can stroke the piston until the safety valve is open. Once the power is turned off, the solenoid valve can equalize the pressure across the piston, and the retraction device can close the safety valve.

In examples involving the ICV, the solenoid valve can be used to control a direction of stroking the piston. For example, electricity can be applied to the piezoelectric pump, which can stroke the piston as described above. Turning the solenoid valve on or off can switch a direction of stroking the piston. For example, the hydraulic supply line and the hydraulic return line may be arranged to cause the piezoelectric pump to stroke the piston in a first direction when the solenoid valve is on, and the hydraulic supply line and the hydraulic return line may be arranged to cause the piezoelectric pump to stroke the piston in a second direction when the solenoid valve is off. The control of the ICV provided by the system can allow the ICV to be at least partially opened to provide greater control over a volume of production from the wellbore.

In some examples, the system can include or otherwise be used with a control system such as an electronic control system. The control system can be used to control more than one, such as two, three, four, 8, 12, 20, or more than 20, combination of piezoelectric pump and solenoid valve. The control system can facilitate a fully electric actuation system with minimal electric components. For example, the fully electric actuation system may involve zero electric components, one electric components, two electric components, or the like. The electric components may include a diode, a silicon diode for alternating current (SIDAC), or the like. In some examples, the SIDAC may be or include a diode having a threshold voltage and approximately infinite resistance in a first direction of current. Once the threshold voltage is achieved, the resistance is removed to allow current in the first direction.

In some examples, the system can include a pressure compensation subsystem to balance a pressure between wellbore fluids and hydraulic fluid included in the hydraulic supply line and the hydraulic return line. The pressure compensation subsystem can include a rubber diaphragm, a metal bellows, other devices for pressure compensation, or any combination thereof.

The system can include or otherwise be used for a safety feature. For example, and to prevent the piezoelectric pump from over-stroking the piston in any direction, a limit switch or a position sensor can be included in the system. The limit switch or the position sensor can be used to stop the piezoelectric pump, for example by preventing electricity from being provided to the piezoelectric pump, when the piston is fully stroked, or otherwise stroked to a desirable position, then to power the piezoelectric pump back on if minor leaks or other forces cause the piston to retract past the fully stroked position or the desired position. Additionally or alternatively, the limit switch or the position sensor can result in the signal provided to convert from AC to DC. The DC signal can keep the solenoid electrically powered on but may not cause the pump to reciprocate. Additionally or alternatively, power can be switched to a brake mechanism when the piston is fully stroked or otherwise stroked to a desired position. The brake mechanism can release the piston when the power is removed.

The system can allow testing of the wellbore tools or other equipment. For example, the system can test the safety valve periodically without closing the safety valve. In this example, voltage can be slowly dropped until the solenoid valve is leaking very slowly to cause the piston to retract quasi-statically. The retraction can be stopped a short distance before fully un-supporting the safety valve by switching the piezoelectric pump back on to return to full stroke or otherwise desired stroke. By slowly retracting the piston without fully closing the safety valve, the system can be tested without interrupting production or other suitable wellbore operations.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a wellbore 102 that can use a piezoelectric pump 104 to control a wellbore tool 108 according to one example of the present disclosure. The wellbore 102 can be positioned or otherwise formed in a subterranean formation 105. In some examples, a reservoir 106 may be located in, or proximate to, the subterranean formation 105, and the reservoir 106 may be subjected to a production operation or other suitable operations via the wellbore 102.

A wellbore tool 108 can be positioned in the wellbore 102 to perform one or more wellbore operations with respect to the wellbore 102. For example, the wellbore tool 108 can include a safety device, a flow control device, other suitable wellbore tools, or any combination thereof. The safety device can include a flapper valve or other safety valve that can be used to control production, for example from the reservoir 106. The flow control device can be or include an inflow control device (ICV) that may be positioned on a tubing 114 to control flow of fluid or other material with respect to the subterranean formation 105.

The wellbore tool 108 may be coupled with the piezoelectric pump 104. For example, The piezoelectric pump 104 may be included in a piezoelectric pump system that can additionally include a solenoid valve, one or more hydraulic lines, a piston, and the like. The piezoelectric pump system can be coupled with the wellbore tool 108. For example, the one or more hydraulic lines may be attached to the wellbore tool 108 to cause the wellbore tool 108 to be in hydraulic communication with the piezoelectric pump system. In other examples, the wellbore tool 108 may be at least indirectly coupled with the piezoelectric pump system. In a particular example, the piezoelectric pump system may be coupled with one or more ports of the tubing 114, and the one or more ports of the tubing 114 may be coupled with the wellbore tool 108 to cause the wellbore tool 108 to at least indirectly be coupled with the piezoelectric pump system. In other examples the piezoelectric pump system may be housed inside wellbore tool 108. In this example only the electric line penetrates through tubing 114 and the piezoelectric pump and hydraulic lines are housed inside wellbore tool 108.

In some examples, a computing device 140 can be positioned at a surface 110 of subterranean formation 105. Additionally or alternatively, a control device 112 can be positioned at the surface 110 of the subterranean formation 105. The control device 112 may be connected to the computing device 140 to allow one or more wellbore operations with respect to the wellbore 102 to be performed. In other examples, a different device other than the control device 112 can be used. In a particular example, the computing device 140, for example using the control device 112, can determine to turn on or off the piezoelectric pump 104, to select one or more other piezoelectric pumps to turn on or off, and the like.

In some examples, the tubing 114 can be positioned in the wellbore 102. The tubing may be or include various types of strings, such as a work string, a drill string, a completion string, and the like. The tubing 114 can be used to facilitate production such as from the reservoir 106, from the subterranean formation 105, or from other suitable sources. For example, the piezoelectric pump 104 can be selectively turned on or off to control the wellbore tool 108, which may cause fluid or other material to be produced or choked using the wellbore 102. In a particular example, the wellbore tool 108 that can be positioned on the tubing 114 may be an ICV, and the piezoelectric pump system may selectively be turned on to cause the ICV to displace in one or more directions to close, choke or open communication between tubing 114 and the subterranean formation 105 to produce or inject a particular type of fluid.

Figure 2:
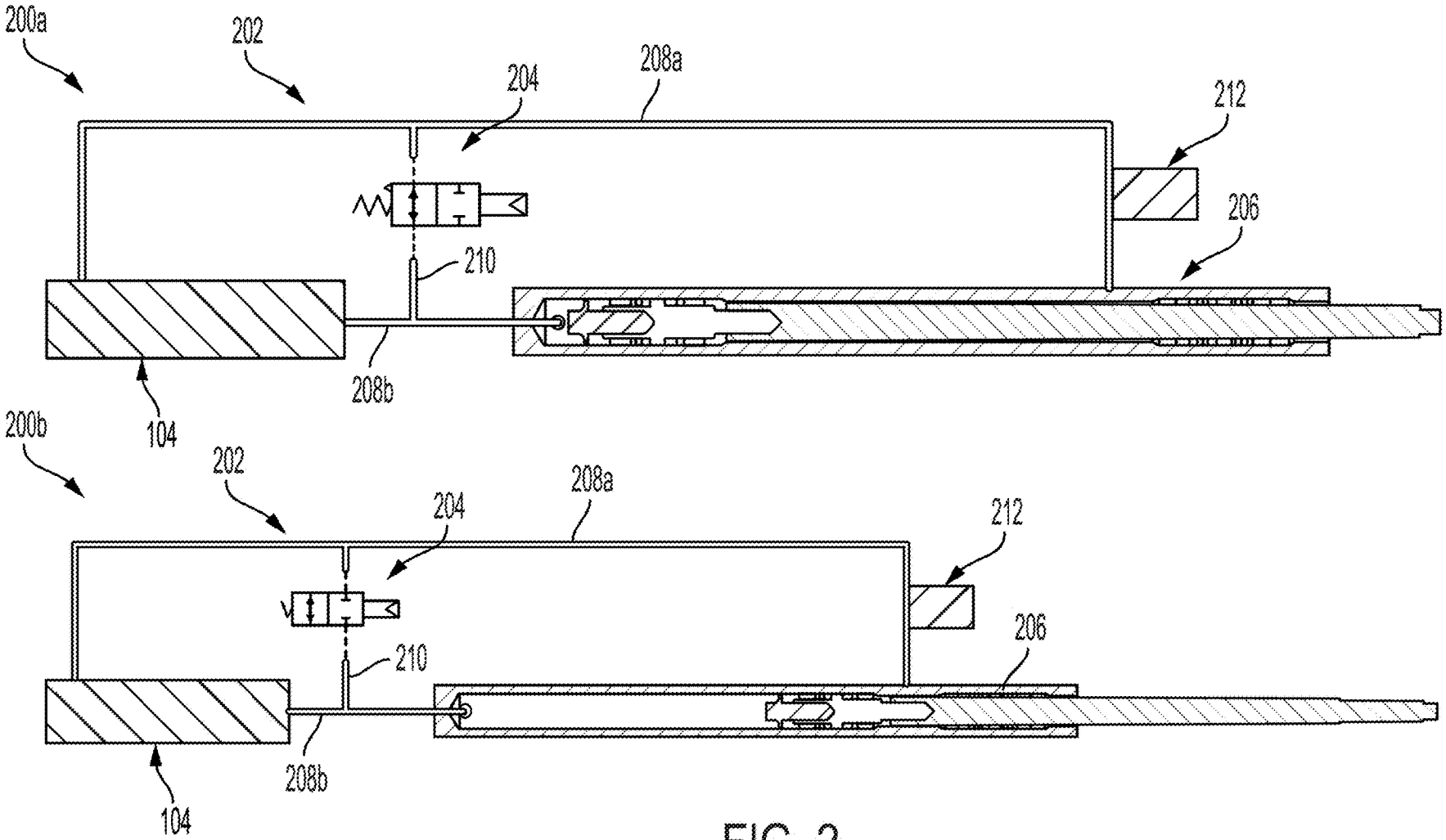
FIG. 2 is a set of diagrams of a system including a piezoelectric pump that can be used to control a wellbore tool according to one example of the present disclosure.

FIG. 2 is a set of diagrams 200*a-b* of a system including a piezoelectric pump 104 that can be used to control a wellbore tool according to one example of the present disclosure. As illustrated in FIG. 2, a piezoelectric pump system 202 can include the piezoelectric pump 104, a solenoid valve 204, and a piston 206. Other suitable components or subsystems may be included in the piezoelectric pump system 202. For example, the piezoelectric pump system 202 can include a first hydraulic line 208*a*, a second hydraulic line 208*b*, a hydraulic bypass 210, a pressure regulation device 212, and the like. The system can also include accumulators or spring loaded accumulators (not shown) on the high pressure side or low pressure side or both to minimize pressure fluctuations or increase the time it takes to reduce the high pressure if the solenoid valve 204 is slowly leaking, which, in turn, minimizes pump cycle time.

The piezoelectric pump 104 can be or include a piezoelectric stack that, when exposed to electricity, such as alternating current electricity, deforms or vibrates to cause fluid to be pumped or otherwise displaced. The solenoid valve can be electrically coupled with the piezoelectric pump 104. For example, the solenoid valve 204 can be electrically coupled in series or in parallel with the piezoelectric pump 104 with a common electrical cable or with separate electrical cables, which may originate from uphole with respect to the piezoelectric pump system 202. The solenoid valve 204 may be or include a solenoid that can have at least a first setting (e.g., an off setting) and a second setting (e.g., an on setting) that can be selected by providing (or not providing) electrical power to the solenoid valve 204. The piston 206 can be coupled, such as via the first hydraulic line 208*a* and the second hydraulic line 208*b*, with the piezoelectric pump 104 to transfer hydraulic force from the piezoelectric pump system 202 to the wellbore tool 108. For example, the piston 206 may be positioned to receive differential pressure to apply a force to the wellbore tool 108 by contacting at least a portion of the wellbore tool 108. The first hydraulic line 208*a* and the second hydraulic line 208*b* may include tubes or other type of conduit that can convey hydraulic fluid or otherwise convey hydraulic force. The hydraulic bypass 210 may couple the solenoid valve 204 with the first hydraulic line 208*a* and the second hydraulic line 208*b* to facilitate selection of a direction of actuation of the piston 206. The pressure regulation device 212 may be or include a metal bellows, a diaphragm, or other suitable type of pressure regulation device that can regulate pressure, for example between hydraulic fluid in the piezoelectric pump system 202 and wellbore fluid in the wellbore 102.

The piezoelectric pump system 202 can be used to control actuation of a wellbore tool 108. For example, electrical power, such as via electricity, can be conveyed to the piezoelectric pump system 202, and the electrical power can cause the piezoelectric pump 104 to apply differential pressure along the second hydraulic line 208*b*, which may be or include a hydraulic application line. Additionally or alternatively, and depending on whether the solenoid valve 204 is activated, the differential pressure generated by the piezoelectric pump 104 can be applied to the piston 206 or balanced through the first hydraulic line 208*a*, which may be or include a hydraulic return line.

As illustrated in FIG. 2, a first diagram 200*a* can illustrate the piezoelectric pump system 202 in a resting state. In the resting state, the piston 206 may not be stroked or otherwise displaced. Additionally, in the resting state, the solenoid valve 204 may be in the second setting, which may involve the solenoid valve 204 being "off" or "open" to allow hydraulic pressure to be transferred across the hydraulic bypass 210. In response to receiving electrical power, the piezoelectric pump 104 may generate differential pressure and apply the differential pressure to hydraulic fluid positioned in the second hydraulic line 208*b*. Since the solenoid valve 204 is in the second setting, the differential pressure may be balanced or equalized throughout the piezoelectric pump system 202 since the differential pressure can be conveyed across the hydraulic bypass 210. Thus, the piston 206 may not be displaced. This state can allow external forces to move the wellbore tool 108 along with the piston 206 freely such as a spring closing a safety valve or a shifting tool manually shifting an ICV.

As illustrated in FIG. 2, a second diagram 200*b* can illustrate the piezoelectric pump system 202 in a stroke state. In the stroke state, the piston 206 may receive the differential pressure and may be displaced to cause the wellbore tool 108 to actuate. The solenoid valve 204 may be switched to the first setting, which may involve the solenoid valve 204 being "on" or "closed" to prevent hydraulic force from being transferred across the hydraulic bypass 210. In response to receiving electrical power, the piezoelectric pump 104 may generate differential pressure and apply the differential pressure to hydraulic fluid positioned in the second hydraulic line 208*b*. Since the solenoid valve 204 is in the first setting, the differential pressure may not be balanced or equalized throughout the piezoelectric pump system 202 since the differential pressure may not be conveyed across the hydraulic bypass 210. Thus, the piston 206 may receive the differential pressure and can be displaced to cause the wellbore tool 108 to actuate.

Figure 3:
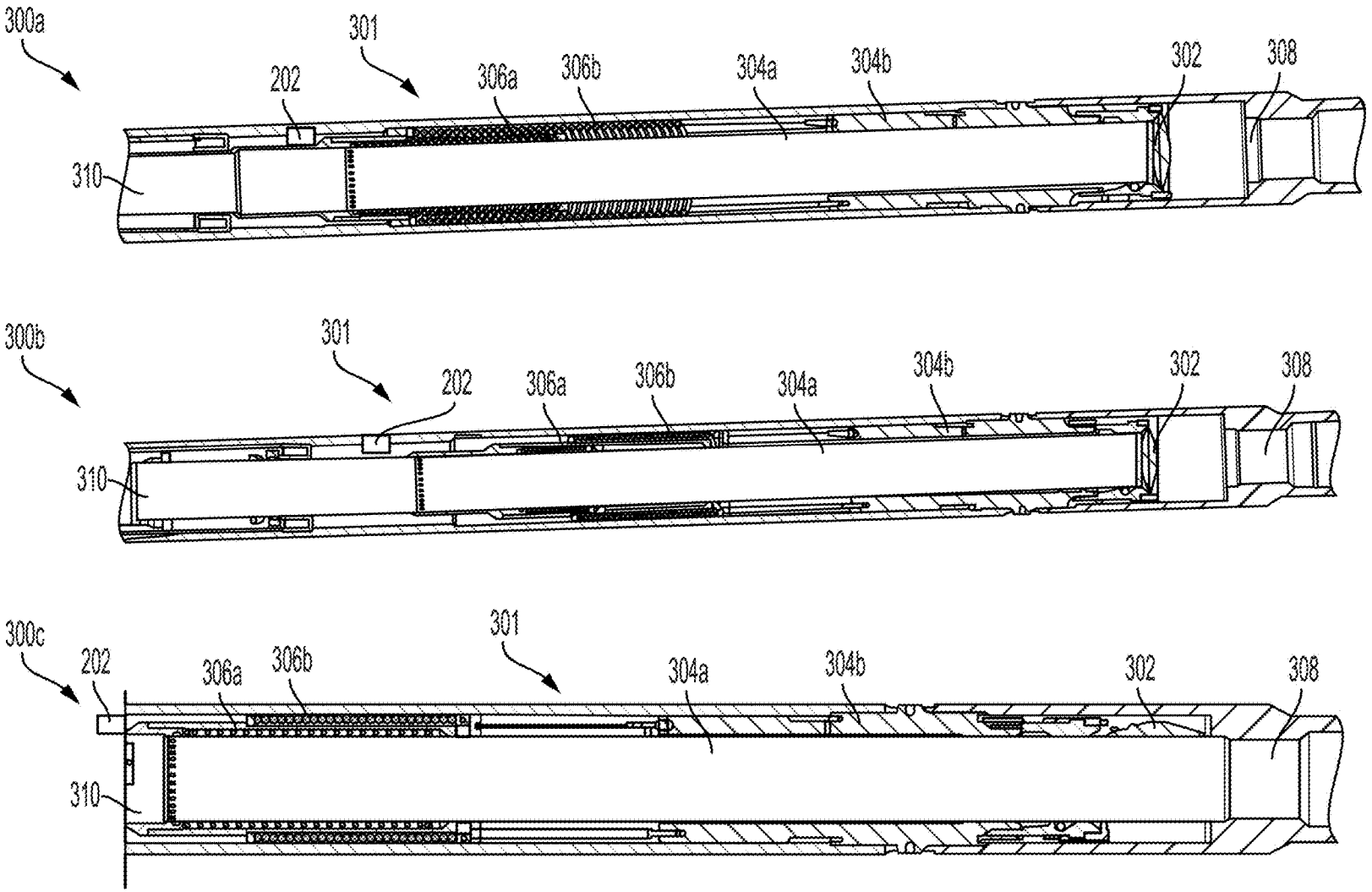
FIG. 3 is a set of views of downhole equipment with a safety valve that can be controlled by a system with a piezoelectric pump according to one example of the present disclosure.

FIG. 3 is a set of views 300*a-c* of downhole equipment 301 with a safety valve 302 that can be controlled by a system with a piezoelectric pump, such as the piezoelectric pump system 202, according to one example of the present disclosure. FIG. 3 includes a first view 300*a*, a second view 300*b*, and a third view 300*c*, each of which may be a sectional view of the downhole equipment 301 that can include the piezoelectric pump system 202 for controlling the safety valve. In some examples, the set of views 300*a-c* may represent different stages of a process involving the safety valve 302, the piezoelectric pump system 202, and the like. As illustrated in FIG. 3, the downhole equipment 301 can include the safety valve 302 (e.g., a flapper), a first tubular 304*a*, a second tubular 304*b*, a first spring 306*a*, a second spring 306*b*, other suitable components, or any combination thereof.

The first tubular 304*a* may be positioned concentrically, or otherwise suitably, within the second tubular 304*b*. Additionally or alternatively, the first spring 306*a* may be positioned concentrically, or otherwise suitably, within the second spring 306*b*. In some examples, the first spring 306*a*, the second spring 306*b*, or a combination thereof may be coupled with, for example via the piston 206, the piezoelectric pump system 202. For example, the first spring 306*a*, the second spring 306*b*, or a combination thereof may be adjacent to the piston 206 or to any other suitable component of the piezoelectric pump system 202. Additionally or alternatively, an uphole side 310 of the downhole equipment can be affixed to the piston 206. The first spring 306*a*, the second spring 306*b*, or a combination thereof may be or include a retraction device that can be used to facilitate actuation of the safety valve 302 in at least one direction.

As illustrated in the first view 300*a*, the downhole equipment 301 may be in an initial state or a resting state. For example, the piezoelectric pump system 202 may be turned off or otherwise may not be receiving electrical power. Additionally or alternatively, the first spring 306*a* and the second spring 306*b* may be in a resting state in which spring force applied from the first spring 306*a*, the second spring 306*b*, or a combination thereof is in equilibrium with other forces (e.g., a stroke force provided by the piezoelectric pump system 202, etc.) on the first spring 306*a*, the second spring 306*b*, or a combination thereof. The safety valve 302 may be closed, which may prevent fluid or other material flowing within the downhole equipment 301. For example, fluid or other material originating from a downhole side 308 of the downhole equipment 301 may not be able to pass through or traverse the safety valve 302 and travel toward an uphole side 310 of the downhole equipment 301.

As illustrated in the second view 300*b*, the piezoelectric pump system 202 may be turned on, for example by providing electrical power to the piezoelectric pump system 202 or any component thereof such as the piezoelectric pump 104, the solenoid valve 204, etc. Additionally or alternatively, the solenoid valve 204 of the piezoelectric pump system 202 may be used to select an "on" or a "closed" position to cause the piezoelectric pump system 202 to apply a compression force to the first spring 306*a*, the second spring 306*b*, or a combination thereof to displace the first tubular 304*a*, the uphole side 310 of the downhole equipment 301, or a combination thereof. In some examples, the compression force may be generated via differential pressure being applied to the piston 206 from the piezoelectric pump 104, and the piston 206 may convert the received different pressure to the compression force and apply the compression force to the first spring 306*a*, the second spring 306*b*, or a combination thereof.

As illustrated in the second view 300*b*, the first spring 306*a* and the second spring 306*b* are compressed, but the safety valve 302 is closed. In some examples, a first pressure, for example originating from downhole with respect to the downhole equipment 301, may be larger than a second pressure, for example originating within or from uphole with respect to the downhole equipment 301. Thus, since the first pressure is higher than the second pressure, the safety valve 302 may remain shut and may continue to prevent at least a portion of fluid or material from traversing the downhole equipment 301.

As illustrated in the third view 300*c*, the safety valve 302 is opened to allow the downhole equipment 301 to facilitate a production operation or to otherwise allow fluid or material to flow through the downhole equipment 301. In some examples, the second pressure can be adjusted to control the safety valve 302 or any other suitable components of the downhole equipment 301. For example, the second pressure can be increased from surface to approximately match the first pressure, and the equalization of the first pressure and the second pressure can cause the first spring 306*a* to relax or otherwise apply a spring force to the first tubular 304*a*. In response to the first spring 306*a* relaxing or applying spring force to the first tubular 304*a*, the first tubular 304*a* can be displaced, which can cause the safety valve 302 to be opened. In some examples, the safety valve 302 can remain open until the second pressure is adjusted (e.g., decreased or removed), until the piezoelectric pump system 202 is turned off (e.g., electrical power is removed), until the solenoid valve 204 is turned into the "off" or "open" setting, or the like.

In a particular example, the piezoelectric pump system 202 can include or be coupled with a limit switch or position sensor. The limit switch can be coupled with the piston 206, with other suitable components of the piezoelectric pump system 202, with suitable components of the downhole equipment 301, or the like. The limit switch can be used to limit a displacement of the piston 206 and, by extension, the first spring 306*a*, the second spring 306*b*, the first tubular 304*a*, and the uphole side 310 of the downhole equipment 301. The limit switch can be used to control electrical power provided to the piezoelectric pump system 202, or to any components thereof (e.g., the piezoelectric pump 104) in response to the piston 206 being displaced to a threshold displacement. For example, the limit switch can cause electrical power to be removed from the piezoelectric pump system 202, or from any component thereof, in response to the piston 206 displacing to or beyond the threshold displacement.

Figure 4:
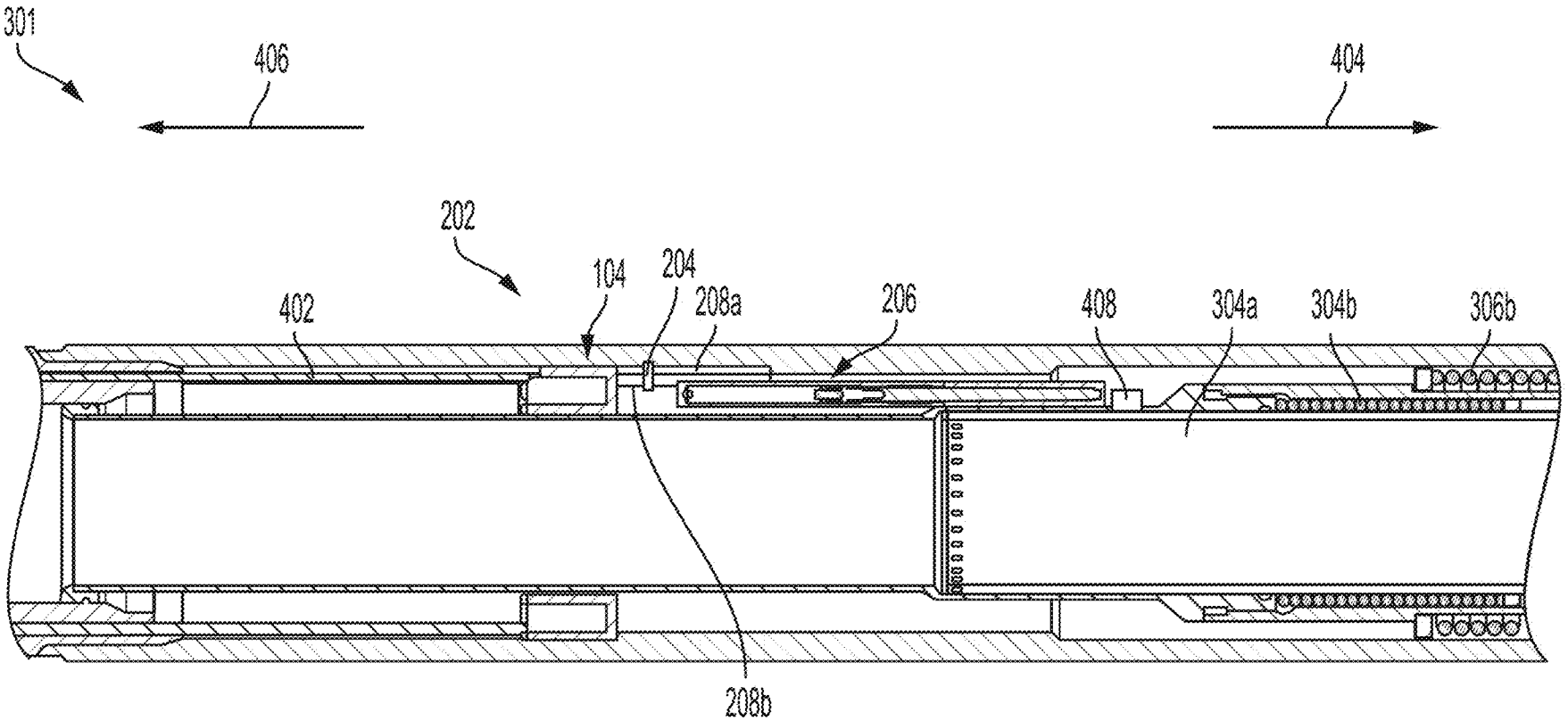
FIG. 4 is a sectional view of downhole equipment that includes a system with a piezoelectric pump that can be used to control a safety valve according to one example of the present disclosure.

FIG. 4 is a sectional view of downhole equipment 301 that includes a system with a piezoelectric pump that can be used to control a safety valve 302 according to one example of the present disclosure. In some examples, the system with a piezoelectric pump may be or include the piezoelectric pump system 202, though other suitable systems with a piezoelectric pump can be used. As illustrated in FIG. 4, the piezoelectric pump system 202 can include the piezoelectric pump 104, the solenoid valve 204, the piston 206, the first hydraulic line 208*a*, and the second hydraulic line 208*b*, though other or additional components (e.g., the hydraulic bypass 210) are possible to include in the piezoelectric pump system 202.

The piezoelectric pump 104 may be connected, for example via cable 402, to one or more tools. The one or more tools may be positioned at the surface 110 of the wellbore 102, may be positioned uphole with respect to the piezoelectric pump 104, or in other suitable locations. In some examples, the one or more tools may provide electrical power to the piezoelectric pump 104. For example, the one or more tools may generate or otherwise convey electrical power, such as alternating current electricity, along the cable 402 to the piezoelectric pump 104. The piezoelectric pump 104 can receive the electrical power and may deform or otherwise activate to pump hydraulic fluid included in the first hydraulic line 208*a*, in the second hydraulic line 208*b*, or a combination thereof.

The solenoid valve 204 can be adjusted to determine whether to cause the piston 206 to stroke in a first direction, to stroke in a second direction, or to be halted (e.g., not stroked). Stroking the piston 206 can involve causing the piston 206 to displace in at least one direction. For example, a first direction 404 can be approximately in a downhole direction, and a second direction 406 can be approximately in an uphole direction, though other direction configurations are possible. Activating the piezoelectric pump 104 and adjusting the solenoid valve 204 to be in a closed setting can cause the piezoelectric pump 104 to build differential pressure and apply the differential pressure along the second hydraulic line 208*b*. The piston 206 can receive the differential pressure and can be displaced in the first direction 404. In some examples, displacing the piston 206 along the first direction 404 can facilitate control of a wellbore tool such as the safety valve 302. In a particular example, and in response to displacing the piston 206 and applying pressure to the downhole equipment 301 from the surface, the safety valve 302 can be opened to allow a production operation, or other suitable operations, to be performed.

In some examples, a limit switch 408 can be positioned on the piston 206, on at least a portion of the downhole equipment 301, or in other suitable locations. The limit switch 408 can be used to control electrical power provided to the piezoelectric pump system 202, or to any components thereof (e.g., the piezoelectric pump 104) in response to the piston 206 being displaced to a threshold displacement. For example, the limit switch 408 can cause electrical power to be removed from the piezoelectric pump system 202, or from any component thereof, in response to the piston 206 displacing to or beyond the threshold displacement.

The solenoid valve 204 can be adjusted to halt or reverse or otherwise change a direction of stroking the piston 206. For example, the solenoid valve 204 can be switched into the "off" or "open" setting, which may allow hydraulic communication between the first hydraulic line 208*a* and the second hydraulic line 208*b*. The differential pressure may be equalized throughout the piezoelectric pump system 202, which may allow the first spring 306*a*, the second spring 306*b*, or a combination thereof to stroke the piston 206 in the second direction 406. For example, the first spring 306*a*, the second spring 306*b*, or a combination thereof may apply spring force to the piston 206 to return the piston 206 to a resting state, which may cause the safety valve 302 to shut. In other examples, and in response to stroking the piston 206 a desired length, electrical power may be cut off from the piezoelectric pump 104, which may cause the pressure in the piezoelectric pump system 202 to remain constant. Constant differential pressure may cause the piston 206, the first tubular 304*a*, the second tubular 304*b*, the first spring 306*a*, the second spring 306*b*, and any other suitable moving components within the downhole equipment to be static or otherwise locked in place.

Figure 5:
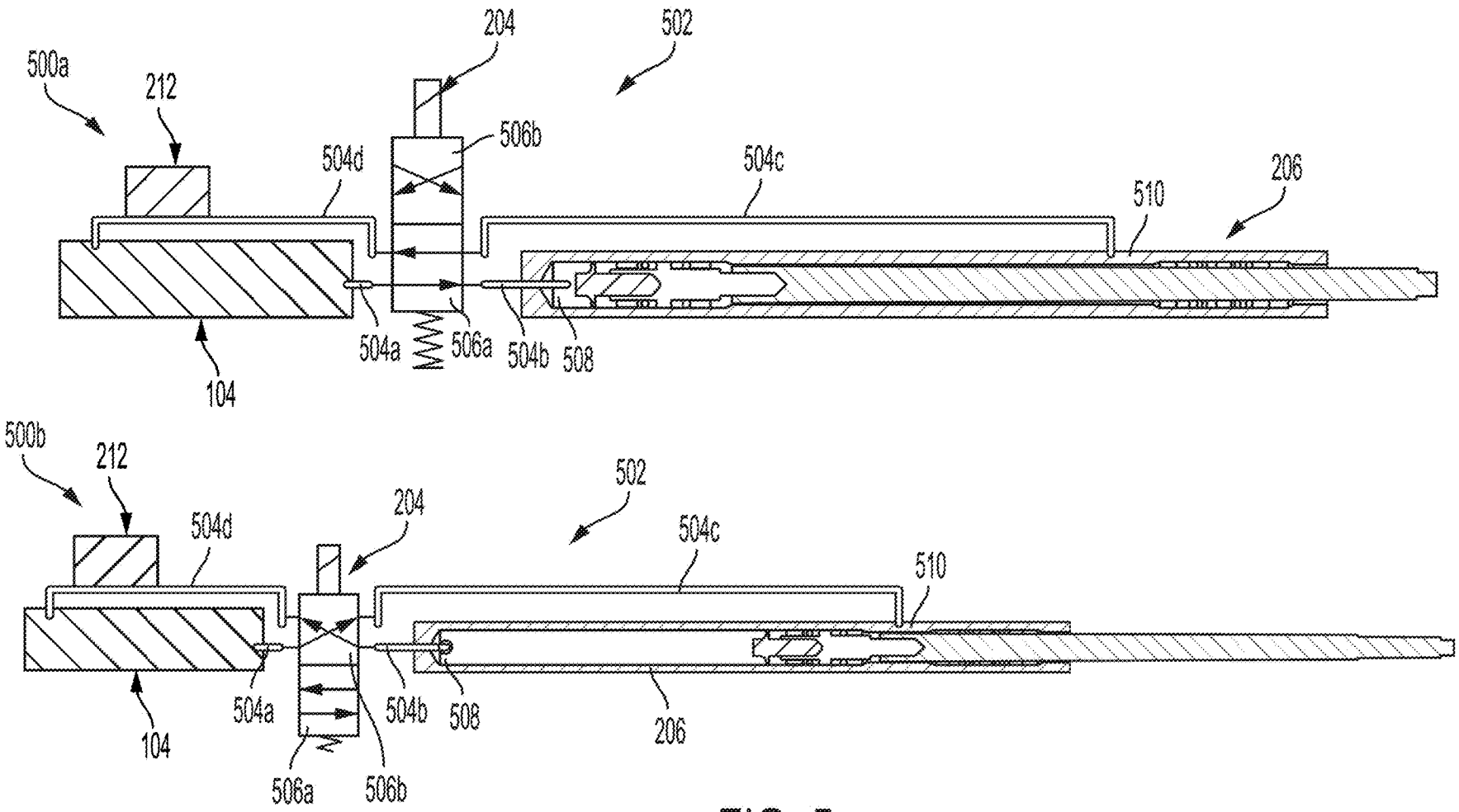
FIG. 5 is a set of diagrams of another system including a piezoelectric pump that can be used to control a wellbore tool according to one example of the present disclosure.

FIG. 5 is a set of diagrams 500*a-b* of another system, such as piezoelectric pump system 502, including a piezoelectric pump 104 that can be used to control a wellbore tool according to one example of the present disclosure. As illustrated in FIG. 5, the piezoelectric pump system 502 can include the piezoelectric pump 104, a solenoid valve 204, and a piston 206. Other suitable components or subsystems may be included in the piezoelectric pump system 502. For example, the piezoelectric pump system 502 can include a first hydraulic line 504*a*, a second hydraulic line 504*b*, a third hydraulic line 504*c*, a fourth hydraulic line 504*d*, a pressure regulation device 212, and the like.

The piezoelectric pump 104 can be or include a piezoelectric stack that, when exposed to electricity, such as alternating current electricity or direct current electricity, can deform or vibrate to cause fluid to be pumped or otherwise displaced. The solenoid valve 204 may be or include a solenoid that can have at least a first setting 506*a* and a second setting 506*b* that can be selected by providing (or not providing) electrical power to the solenoid valve 204. The first setting 506*a* may cause the piezoelectric pump system 502 to function in a first arrangement, and the second setting 506*b* may cause the piezoelectric pump system 502 to function in a second arrangement. The first arrangement and the second arrangement may have different flows of differential pressure or hydraulic fluid through the first hydraulic line 504*a*, the second hydraulic line 504*b*, the third hydraulic line 504*c*, and the fourth hydraulic line 504*d*. The piston 206 can be coupled, such as via the first hydraulic line 504*a*, the second hydraulic line 504*b*, the third hydraulic line 504*c*, and the fourth hydraulic line 504*d*, with the piezoelectric pump 104 to transfer force from the piezoelectric pump system 502 to a wellbore tool such as the wellbore tool 108. For example, the piston 206 may be positioned to receive differential pressure and to apply the differential pressure to the wellbore tool 108 by contacting at least a portion of the wellbore tool 108. The pressure regulation device 212 may be or include a metal bellows, a diaphragm, or other suitable type of pressure regulation device that can regulate pressure, for example between hydraulic fluid in the piezoelectric pump system 502 and wellbore fluid in the wellbore 102.

The first hydraulic line 504*a*, the second hydraulic line 504*b*, the third hydraulic line 504*c*, and the fourth hydraulic line 504*d* may include tubes or other type of conduit that can convey hydraulic fluid or that can otherwise convey hydraulic force. The first hydraulic line 504*a* may extend from the piezoelectric pump 104 to the solenoid valve 204, the second hydraulic line 504*b* may extend from the solenoid valve 204 to a first side 508 of the piston 206, the third hydraulic line 504*c* may extend from a second side 510 of the piston 206 to the solenoid valve 204, and the fourth hydraulic line 504*d* may extend from the solenoid valve 204 to the piezoelectric pump 104.

In some examples, an arrangement of the first hydraulic line 504*a*, the second hydraulic line 504*b*, the third hydraulic line 504*c*, and the fourth hydraulic line 504*d* can be adjusted by switching the solenoid valve 204 between the first setting 506*a* and the second setting 506*b*. For example, such as when the solenoid valve 204 is set to the first setting 506*a*, a first arrangement of the first hydraulic line 504*a*, the second hydraulic line 504*b*, the third hydraulic line 504*c*, and the fourth hydraulic line 504*d* is illustrated in the first diagram 500*a* in which the piezoelectric pump 104 can apply differential pressure to the first hydraulic line 504*a*, which transfers the differential pressure to the second hydraulic line 504*b*. Additionally in the first arrangement, a combination of the third hydraulic line 504*c* and the fourth hydraulic line 504*d* may be a hydraulic return line. In other examples, such as when the solenoid valve 204 is set to the second setting 506*b*, a second arrangement of the first hydraulic line 504*a*, the second hydraulic line 504*b*, the third hydraulic line 504*c*, and the fourth hydraulic line 504*d* is illustrated in the second diagram 500*b* in which the piezoelectric pump 104 can apply differential pressure to the first hydraulic line 504*a*, which transfers the differential pressure to the third hydraulic line 504*c*. Additionally in the second arrangement, a combination of the second hydraulic line 504*b* and the fourth hydraulic line 504*d* may be the hydraulic return line.

In the first arrangement, the piezoelectric pump system 502 can apply differential pressure to the piston 206 in a first direction, and in the second arrangement, the piezoelectric pump system 502 can apply the differential pressure to the piston in a second direction that is different than the first direction. Additionally or alternatively, in the first arrangement, the piston 206 may be displaced in the first direction, and in the second arrangement, the piston 206 may be displaced in the second direction. The direction of stroking the piston 206 may be finely controlled to provide control over the wellbore tool 108. For example, such as examples in which the wellbore tool 108 is an ICV, the direction of stroking the piston 206 can be controlled to close or to open to a desired opening size the ICV to control flow of fluid between tubing and annulus. In some examples, the piezoelectric pump system 502 can be used to control actuation of a wellbore tool 108. For example, electrical power, such as via electricity, can be conveyed to the piezoelectric pump system 502, and the electrical power can cause the piezoelectric pump 104 to apply differential pressure to the first side 508 of the piston 206 or to the second side 510 of the piston 206.

In some examples, the second hydraulic line 504*b* and the third hydraulic line 504*c* may be or include inflow ports. An inflow port may be or include a hydraulic line that may convey hydraulic pressure or communication originating exterior from the downhole equipment to the piston 206, which may be positioned within the downhole equipment. For example, the piezoelectric pump system 502 may be positioned on an exterior surface of, or otherwise in a suitable exterior location with respect to, the downhole equipment 301, and the first setting 506*a* or the second setting 506*b* of the solenoid valve 204 can be selected to cause the differential pressure to be applied to the piston 206 via the inflow port, which may be selected as the second hydraulic line 504*b* or the third hydraulic line 504*c*.

Figure 6:
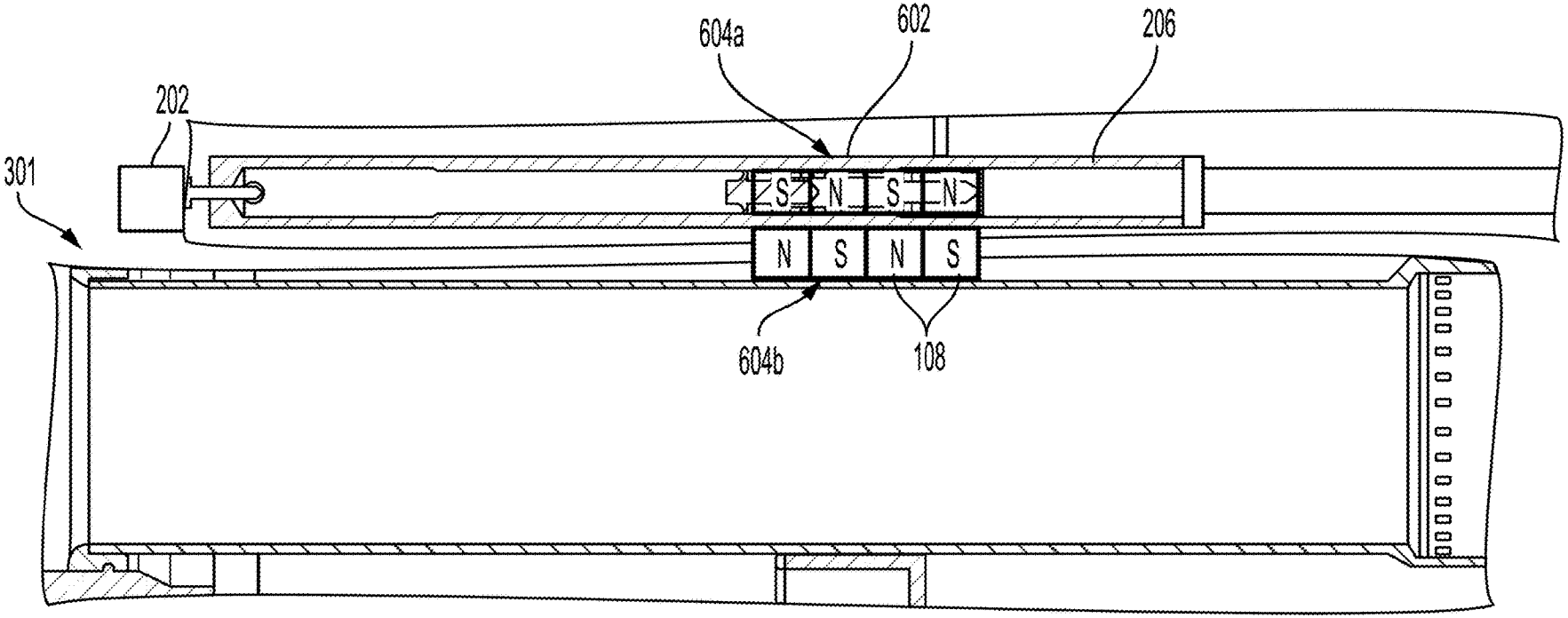
FIG. 6 is a sectional view of downhole equipment that includes a piezoelectric pump system with a piston that is encased and magnetically coupled with a wellbore tool according to one example of the present disclosure.

FIG. 6 is a sectional view of downhole equipment 301 that includes a piezoelectric pump system 202 with a piston 206 that is encased and magnetically coupled with a wellbore tool 108 according to one example of the present disclosure. As illustrated in FIG. 6, the downhole equipment 301 may include the wellbore tool 108, which may be or include an ICV, a safety valve, or the like. The downhole equipment 301 may also include or be coupled with the piezoelectric pump system 202 that can include the piston 206. In some examples, the piston 206 may be encased such as via encasing 602. The encasing 602 may be positioned to at least partially to fully enclose the piston 206. In some examples, the encasing 602 may be or include a channel in which the piston 206 can be displaced. Additionally or alternatively, a first set of magnets 604*a* and a second set of magnets 604*b* can be positioned to couple the piston 206 and the wellbore tool 108. For example, the first set of magnets 604*a* may be positioned adjacent to or may be affixed to the piston 206, and the second set of magnets 604*b* may be positioned adjacent to or may be affixed to the wellbore tool 108. The arrangement of the first set of magnets 604*a* and the second set of magnets 604*b* can cause the piston 206 and the wellbore tool 108 to be displaced together such that a distance between the piston 206 and the wellbore tool 108 is constant.

Figure 7:
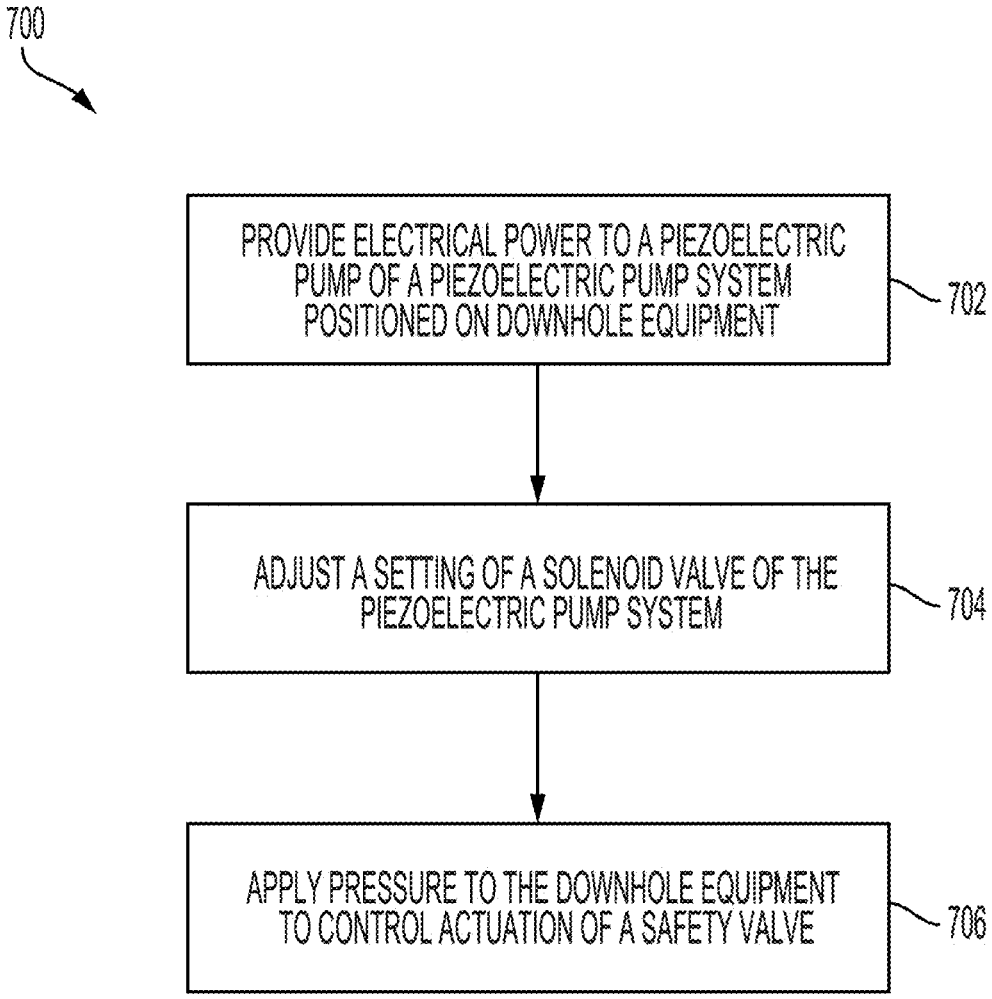
FIG. 7 is a flowchart of a process to control a first example of a wellbore tool using a system with a piezoelectric pump according to one example of the present disclosure.

FIG. 7 is a flowchart of a process 700 to control a first example of a wellbore tool using a system with a piezoelectric pump according to one example of the present disclosure. The first example of the wellbore tool may be or include a safety valve 302, such as a flapper, and the system with a piezoelectric pump may be or include the piezoelectric pump system 202, though other suitable examples of the wellbore tool, the system with the piezoelectric pump, or a combination thereof are possible.

At block 702, electrical power is provided to a piezoelectric pump 104 of the piezoelectric pump system 202. The piezoelectric pump system 202 can be positioned on downhole equipment 301, which can be positioned in a wellbore such as the wellbore 102. The piezoelectric pump 104 may be electrically coupled with a power source, such as a battery, a generator, and the like, to receive the electrical power. In some examples, the piezoelectric pump 104 may be or include a stack of piezoelectric material that, when exposed to electrical power, such as alternating current electricity, may deform. Deforming the stack of piezoelectric material may cause the piezoelectric pump 104 to pump or otherwise displace fluid such as hydraulic fluid. Additionally or alternatively, removing the electrical power may cause the piezoelectric pump 104 to turn off, which may involve the piezoelectric pump 104 no longer pumping or displacing fluid or otherwise returning to a resting state.

At block 704, a setting of a solenoid valve 204 of the piezoelectric pump system 202 is adjusted. The solenoid valve 204 may have at least a first setting (e.g., an "off" or closed setting) and a second setting (e.g., an "on" or open setting). For example, the "off" setting may allow hydraulic pressure to equalize throughout the piezoelectric pump system 202. Equalizing the hydraulic pressure may cause the piezoelectric pump system 202 to return to, or remain in, a resting state in which differential pressure is not generated, not applied, or a combination thereof. The "on" setting may cause hydraulic pressure to build in the piezoelectric pump system 202. For example, in response to turning on the piezoelectric pump 104 and selecting the "on" setting for the solenoid valve 204, the piezoelectric pump 104 can generate differential pressure. The piezoelectric pump 104 can apply the differential pressure to a hydraulic line, such as the second hydraulic line 208*b*, which can cause the differential pressure to be applied to a piston such as the piston 206. The piston 206 may receive the differential pressure and may apply a compression force on one or more retraction devices, such as the first spring 306*a* and the second spring 306*b*, to cause one or more tubulars, such as the first tubular 304*a* and the second tubular 304*b*, of the downhole equipment 301 to displace.

At block 706, pressure is applied to the downhole equipment to control actuation of the safety valve 302. In some examples, the pressure can be applied from the surface 110 of the wellbore 102, or otherwise from uphole with respect to the downhole equipment 301. An amount of pressure applied can be determined based on a second pressure measured in the wellbore 102. For example, the amount of pressure can be determined to be approximately equal to downhole pressure measured below the safety valve 302. Approximately equalizing the applied pressure and the downhole pressure may cause a tubular to which the safety valve 302 is coupled to displace with respect to a second tubular in the downhole equipment 301. By displacing the tubular with the safety valve 302 and equalizing a pressure across the safety valve 302, the safety valve 302 can be actuated. In some examples, actuating the safety valve 302 can involve opening the safety valve 302.

In some examples, the solenoid valve 204 can be adjusted to halt or reverse or otherwise change a direction of displacing the piston 206. For example, the solenoid valve 204 can be switched into the "on" or open setting, which may allow the differential pressure to be equalized or dispersed throughout the piezoelectric pump system 202. Dispersing the differential pressure may allow the one or more retraction devices to displace the piston 206 in a second direction opposite the initial direction. Displacing the piston 206 in the second direction may cause the safety valve 302 to be adjusted or to otherwise be shut. In other examples, and in response to the piston 206 being displaced a desired length, electrical power may be cut off from the piezoelectric pump 104, which may cause the pressure in the piezoelectric pump system 202 to remain constant.

Figure 8:
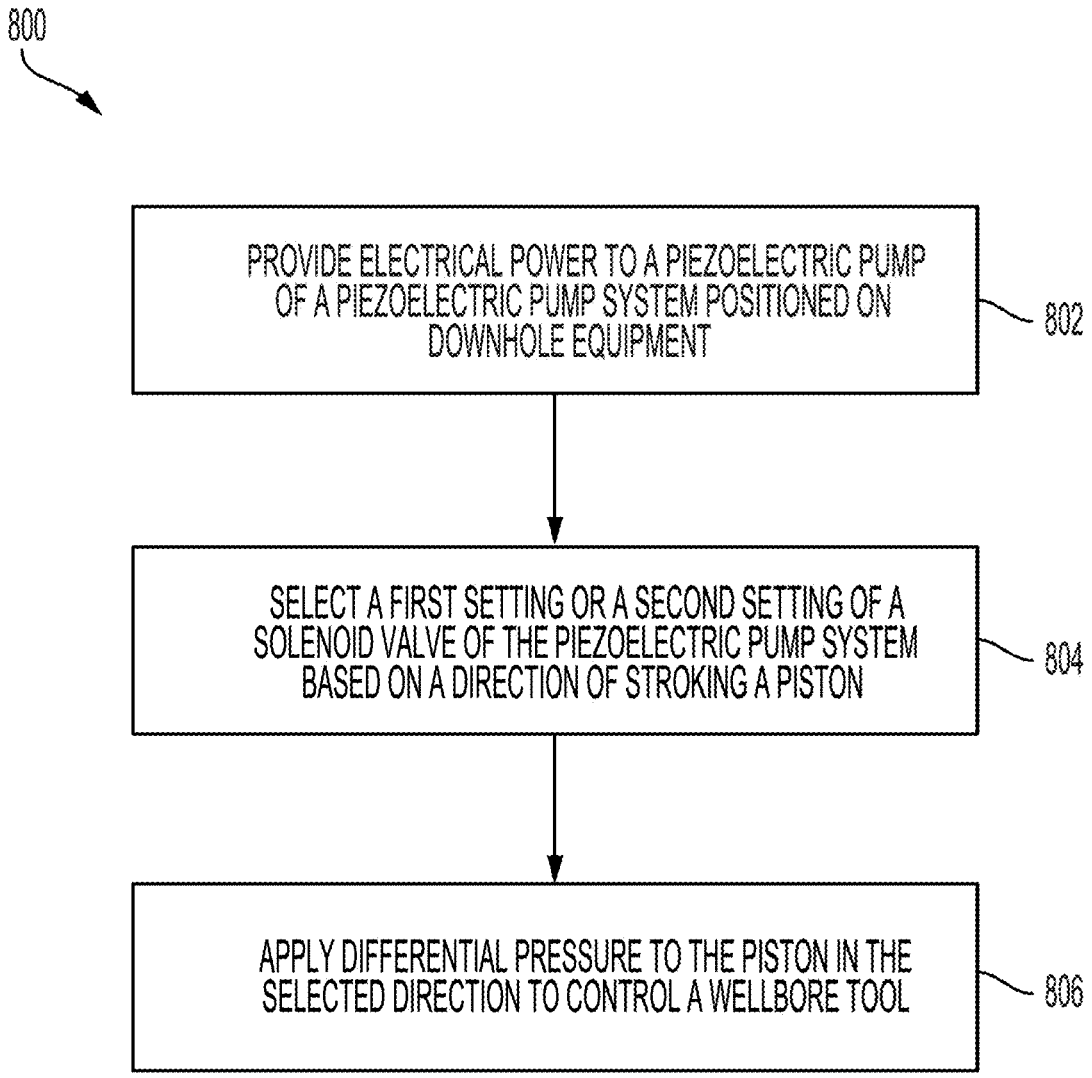
FIG. 8 is a flowchart of a process to control a second example of a wellbore tool using another system with a piezoelectric pump according to one example of the present disclosure.

FIG. 8 is a flowchart of a process 800 to control a second example of a wellbore tool using another system with a piezoelectric pump according to one example of the present disclosure. The second example of the wellbore tool may be or include a flow control device, such as an inflow control valve (ICV), and the system with a piezoelectric pump may be or include the piezoelectric pump system 502, though other suitable examples of the wellbore tool, the system with the piezoelectric pump, or a combination thereof are possible.

At block 802, electrical power is provided to a piezoelectric pump 104 of the piezoelectric pump system 502. The piezoelectric pump system 502 can be positioned on downhole equipment, which can be positioned in a wellbore such as the wellbore 102. The piezoelectric pump 104 may be electrically coupled with a power source, such as a battery, a generator, and the like, to receive the electrical power. In some examples, the piezoelectric pump 104 may be or include a stack of piezoelectric material that, when exposed to electrical power, such as alternating current electricity, may deform. Deforming the stack of piezoelectric material may cause the piezoelectric pump 104 to pump or otherwise displace fluid such as hydraulic fluid. Additionally or alternatively, removing the electrical power may cause the piezoelectric pump 104 to turn off, which may involve the piezoelectric pump 104 no longer pumping or displacing fluid or otherwise returning to a resting state.

At block 804, a first setting 506*a* of a solenoid valve 204 or a second setting 506*b* of the solenoid valve 204 is selected. Selecting the first setting 506*a* or the second setting 506*b* may involve turning the solenoid valve 204 on or off, or otherwise applying or not applying electrical power to the solenoid valve 204. The first setting 506*a* of the solenoid valve 204 may cause the piezoelectric pump system 502 to be in a first arrangement with respect to hydraulic lines, and the second setting 506*b* of the solenoid valve 204 may cause the piezoelectric pump system 502 to be in a second arrangement with respect to hydraulic lines. The first arrangement may be at least approximately opposite with respect to the second arrangement. For example, in the first arrangement, differential pressure may be applied to a first side of the piston 206 to displace the piston 206 in a first direction, and in the second arrangement, the differential pressure may be applied to a second side of the piston 206 to cause the piston 206 to displace in a second direction approximately opposite the first direction.

At block 806, differential pressure is applied to the piston 206 in the selected direction to control a wellbore tool. The wellbore tool may be or include the ICV, and controlling the wellbore tool may involve opening the ICV, closing the ICV, or partially opening or closing the ICV. In response to selecting the first direction or the second direction by selecting the first setting 506*a* of the solenoid valve 204 or the second setting 506*b* of the solenoid valve 204, and in response to providing electrical power to the piezoelectric pump 104, the piezoelectric pump 104 can apply the differential pressure in the first direction or the second direction. For example, the piezoelectric pump 104 can apply the differential pressure to the first side of the piston 206 to displace the piston 206 in the first direction, and the piezoelectric pump 104 can apply the differential pressure to the second side of the piston 206 to displace the piston 206 in the second direction. The displaced piston may contact the wellbore tool to displace the wellbore tool or may otherwise cause the wellbore tool to displace in the first direction or the second direction. Displacing the wellbore tool in the first direction may cause the ICV to open, and displacing the wellbore tool in the second direction may cause the ICV to close, or vice versa.

In some examples, the process 600, the process 700, or a combination thereof can be performed with more than one piezoelectric pump 104 or more than one piezoelectric pump system. For example, the piezoelectric pump system 202 or the piezoelectric pump system 502 can include more than one piezoelectric pump, and each piezoelectric pump of the more than one piezoelectric pump can be selectively controlled such as selectively turned on or off. The selective control of the more than one piezoelectric pump can be performed by a controller system that may include a control device, one or more first diodes, and one or more second diodes. In some examples, the one or more first diodes or the one or more second diodes may be silicon diodes for alternating current (SIDACs). The controller system can selectively control the more than one piezoelectric pump to selectively control more than one wellbore tool such as more than one safety valve, more than one ICV, and the like.

Figure 9:
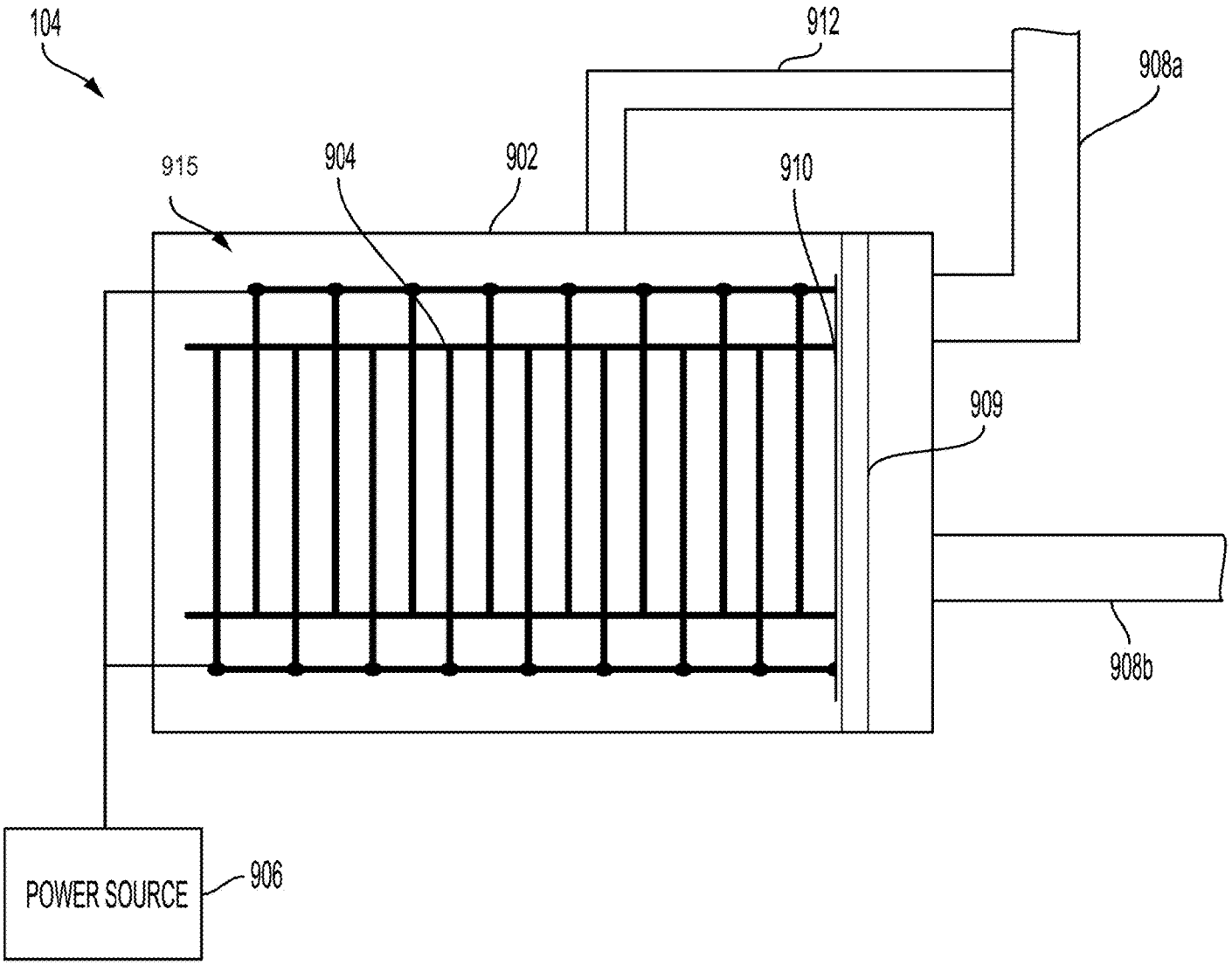
FIG. 9 is a simplified diagram of one example of a piezoelectric pump according to one example of the present disclosure.

FIG. 9 is a simplified diagram of one example of a piezoelectric pump 104 according to one example of the present disclosure. The piezoelectric pump 104 can include an enclosure 902, a piezoelectric stack 904, a power source 906, a first port 908*a*, a second port 908*b*, and a divider 909. The first port 908*a* and the second port 908*b* may be similar or identical to, or may be coupled with, the first hydraulic line 208*a* and the second hydraulic line 208*b*, respectively. In some examples, the piezoelectric pump 104 may include any suitable additional or alternative components. The power source 906 may be or include an AC electricity source, a DC electricity source, or any other suitable source of electrical power. Additionally or alternatively, the piezoelectric pump 104 may be positioned in a wellbore, such as on the downhole equipment 301, and the power source 906 may be positioned uphole, such as at the surface, with respect to the piezoelectric pump 104. In some examples, the enclosure 902 can have a pressure compensation unit that can isolate the enclosure 902, or the piezoelectric stack 904, from fluid being pumped (e.g., within the first port 908*a* or the second port 908*b*) by the piezoelectric pump 104. Additionally or alternatively, the piezoelectric pump 104 can include a pressure balancing line 912, which can extend from the piezoelectric stack 904 to the first port 908*a*, which may be or include a low pressure port. Additionally or alternatively, a piezo stack chamber 915 can have its own pressure balancing system to balance a pressure of the piezo stack chamber 915 with the wellbore pressure separate from the first port 908*a*, the second port 908*b*, or a combination thereof.

Providing power from the power source 906 to the piezoelectric stack 904 can cause the piezoelectric stack 904 to deform or otherwise displace. For example, a first end 910 of the piezoelectric stack 904 may deform or otherwise displace the divider 909, which may be or include a piston or a diaphragm, toward the first port 908*a* or the second port 908*b*. In other examples, providing power from the power source 906 to the piezoelectric stack 904 can cause the piezoelectric stack 904 to pump fluid, such as hydraulic fluid, from an inlet port, such as the first port 908*a*, to an outlet port, such as the second port 908*b*, or vice versa. One or more valves may control a flow of fluid among the piezoelectric stack 904, the first port 908*a*, and the second port 908*b*. In some examples, the solenoid valve 204 may be included in the one or more valves.

In some aspects, systems and methods for a piezoelectric pump for a wellbore tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a piston positionable in a wellbore to control a wellbore tool; a piezoelectric pump coupled with the piston to generate differential pressure, the piston actuatable in a first direction in response to receiving the differential pressure to cause the wellbore tool to actuate in response to receiving additional pressure from uphole with respect to the wellbore; a retraction device coupled with the piezoelectric pump or the piston to facilitate actuating the piston in at least a second direction; and a solenoid valve coupled with the piezoelectric pump to select the first direction or the second direction for actuating the piston.

Example 2 is the system of example 1, wherein the wellbore tool is a safety valve that is closeable to prevent producing material from the wellbore, and wherein the retraction device comprises two or more springs, and wherein the solenoid valve comprises an open setting and a closed setting, wherein the closed setting is usable to select the first direction for actuating the piston, and wherein the open setting is usable to select the second direction for actuating the piston.

Example 3 is the system of any of examples 1-2, wherein the two or more springs comprise (i) a first spring coupled with a first tubular and (ii) a second spring coupled with a second tubular, wherein a compression force from the piston is receivable by the first spring and the second spring to displace the first tubular, and wherein the pressure from uphole with respect to the wellbore is receivable by the first tubular to cause the safety valve to open.

Example 4 is the system of example 1, wherein the piezoelectric pump and the solenoid valve are electrically coupled in series by a common electrical cable that originates at a surface of the wellbore.

Example 5 is the system of example 1, further comprising a limit switch or position sensor coupled with the piston or tool to limit a displacement of the piston, wherein the limit switch is usable to control electrical power provided to the piezoelectric pump in response to the piston being displaced to a threshold displacement.

Example 6 is the system of examples 1, further comprising one or more additional piezoelectric pumps positionable to cause one or more additional wellbore tools to actuate, wherein the piezoelectric pump and the one or more additional piezoelectric pumps are controllable with a control subsystem to selectively actuate the piezoelectric pump and the one or more additional piezoelectric pumps.

Example 7 is the system of any of examples 1 or 6, further comprising the control subsystem, wherein the control subsystem comprises a first type of diode and a second type of diode, wherein the first type of diode or the second type of diode is a silicon diode for alternating current (SIDAC) that is usable to selectively actuate the piezoelectric pump and the one or more additional piezoelectric pumps.

Example 8 is the system of example 1, wherein the piston is encased and magnetically coupled with the wellbore tool to cause the wellbore tool to actuate in response to the piston actuating.

Example 9 is the system of example 1, further comprising: a piezoelectric stack positionable within the piezoelectric pump; a first hydraulic line couplable with a first side of the piston and the piezoelectric pump; and a pressure compensation system couplable with the first hydraulic line to regulate pressure in the system with respect to the wellbore.

Example 10 is the system of any of examples 1 or 9, further comprising a pressure balancing line couplable with the first hydraulic line and the piezoelectric pump to pressure-balance the piezoelectric stack.

Example 11 is the system of any of examples 1 or 9, further comprising: a second hydraulic line couplable with a second side of the piston and the piezoelectric pump; and one or more accumulators couplable with the first hydraulic line or the second hydraulic line to minimize a pump cycle time of the piezoelectric pump.

Example 12 is the system of example 1, further comprising: a piezoelectric stack chamber positionable within the piezoelectric pump to house a piezoelectric stack; and a pressure compensation system couplable with the piezoelectric stack chamber to regulate pressure in the piezoelectric stack chamber with respect to the wellbore.

Example 13 is a system comprising: a piston positionable in a wellbore to control a wellbore tool; a piezoelectric pump coupled with the piston to generate differential pressure, the piston actuatable in at least a first direction or a second direction in response to receiving the differential pressure in the first direction or the second direction, respectively; and a solenoid valve coupled with the piezoelectric pump to selectively cause the piezoelectric pump to apply the differential pressure in the first direction or in the second direction.

Example 14 is the system of example 13, wherein the wellbore tool is an inflow control valve (ICV) that is actuatable to control production of material using the wellbore, and wherein the system further comprises a first hydraulic port corresponding to the first direction and a second hydraulic port corresponding to the second direction.

Example 15 is the system of any of examples 13-14, wherein the first hydraulic port is coupled with a first side of the piezoelectric pump and a first side of the piston, wherein the second hydraulic port is coupled with a second side of the piezoelectric pump and a second side of the piston, wherein the first side of the piezoelectric pump is different than the second side of the piezoelectric pump, wherein the first side of the piston is different than the second side of the piston.

Example 16 is the system of any of examples 13-15, wherein the solenoid valve is positioned along the first hydraulic port and the second hydraulic port, and wherein the solenoid valve is usable to switch a direction of the first hydraulic port and the second hydraulic port.

Example 17 is the system of any of examples 13-16, wherein the solenoid valve comprises an on setting and an off setting, wherein the on setting is usable to select a first arrangement of the first hydraulic port and the second hydraulic port to cause the piezoelectric pump to apply the differential pressure in the first direction, and wherein the off setting is usable to select a second arrangement of the first hydraulic port and the second hydraulic port to cause the piezoelectric pump to apply the differential pressure in the second direction.

Example 18 is the system of example 13, further comprising one or more additional piezoelectric pumps positionable to cause one or more additional wellbore tools to actuate, wherein the piezoelectric pump and the one or more additional piezoelectric pumps are controllable with a control subsystem to selectively actuate the piezoelectric pump and the one or more additional piezoelectric pumps.

Example 19 is the system of any of examples 13 or 18, further comprising the control subsystem, wherein the control subsystem comprises a first type of diode and a second type of diode, and wherein the first type of diode or the second type of diode is a silicon diode for alternating current (SIDAC) that is usable to selectively actuate the piezoelectric pump and the one or more additional piezoelectric pumps.

Example 20 is a method comprising: applying electrical power to a piezoelectric pump to cause the piezoelectric pump to generate differential pressure, the piezoelectric pump positioned in a wellbore; using a solenoid valve coupled with the piezoelectric pump to select a first direction for the differential pressure or a second direction for the differential pressure; and applying the differential pressure on a piston coupled with the piezoelectric pump to displace the piston in the first direction or the second direction to control a wellbore tool positioned in the wellbore.

Example 21 is the method of example 20, wherein the wellbore tool is an inflow control valve (ICV) that is actuated to control production of material using the wellbore, wherein applying the differential pressure comprises applying the differential pressure to a first hydraulic port corresponding to the first direction or to a second hydraulic port corresponding to the second direction.

Example 22 is the method of any of examples 20-21, wherein the first hydraulic port is coupled with a first side of the piezoelectric pump and a first side of the piston, wherein the second hydraulic port is coupled with a second side of the piezoelectric pump and a second side of the piston, wherein the first side of the piezoelectric pump is different than the second side of the piezoelectric pump, wherein the first side of the piston is different than the second side of the piston, and wherein the solenoid valve is positioned along the first hydraulic port and the second hydraulic port.

Example 23 is the method of any of examples 20-22, wherein using the solenoid valve comprises: selecting an on setting of the solenoid valve to select a first arrangement of the first hydraulic port and the second hydraulic port to cause the piezoelectric pump to apply the differential pressure in the first direction; and selecting an off setting of the solenoid valve to select a second arrangement of the first hydraulic port and the second hydraulic port to cause the piezoelectric pump to apply the differential pressure in the second direction.

Example 24 is the method of example 20, further comprising selecting, among a plurality of piezoelectric pumps, the piezoelectric pump or one or more additional piezoelectric pumps to actuate for controlling the wellbore tool or one or more additional wellbore tools.

Example 25 is the method of any of examples 20 or 24, wherein selecting the piezoelectric pump or the one or more additional piezoelectric pumps comprises using a control subsystem to select the piezoelectric pump or the one or more additional piezoelectric pumps, wherein the control subsystem comprises a first type of diode and a second type of diode, and wherein the first type of diode or the second type of diode is a silicon diode for alternating current (SIDAC) that is used to select the piezoelectric pump or the one or more additional piezoelectric pumps.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a piston positionable in a wellbore to control a wellbore tool;

a piezoelectric pump coupled with the piston to generate differential pressure, the piston actuatable in a first direction in response to receiving the differential pressure from a first hydraulic line to cause the wellbore tool to actuate in response to receiving additional pressure from uphole with respect to the wellbore;

a retraction device coupled with the piezoelectric pump and the piston to facilitate actuating the piston in at least a second direction, the retraction device comprising a set of hydraulic lines that has a first arrangement and a second arrangement; and a solenoid valve coupled with the piezoelectric pump to select the first direction or the second direction for actuating the piston, the first arrangement including a first subset of the set of hydraulic lines extending from a first side of the piezoelectric pump through the solenoid valve to a first side of the piston, and the second arrangement including a second subset of the set of hydraulic lines extending from the first side of the piezoelectric pump through the solenoid valve to a second side of the piston, the solenoid valve having:

an on setting to select a first arrangement of the set of hydraulic lines, the first arrangement configured to cause the piezoelectric pump to apply the differential pressure from the first side of the piezoelectric pump to the first side of the piston and to receive return differential pressure from the second side of the piston to a second side of the piezoelectric pump, and an off setting to select a second arrangement of the set of hydraulic lines, the second subset different from the first subset, and the second arrangement configured to cause the piezoelectric pump to apply the differential pressure from the first side of the piezoelectric pump to the second side of the piston and to receive return differential pressure from the first side of the piston to the second side of the piezoelectric pump.

2. The system of claim 1, wherein the wellbore tool is a safety valve that is closeable to prevent producing material from the wellbore, and wherein the retraction device further comprises two or more springs.

3. The system of claim 2, wherein the two or more springs comprise (i) a first spring coupled with a first tubular and (ii) a second spring coupled with a second tubular, wherein a compression force from the piston is receivable by the first spring and the second spring to displace the first tubular, and wherein the pressure from uphole with respect to the wellbore is receivable by the first tubular to cause the safety valve to open.

4. The system of claim 1, wherein the piezoelectric pump and the solenoid valve are electrically coupled in series by a common electrical cable that originates at a surface of the wellbore.

5. The system of claim 1, further comprising a limit switch or position sensor coupled with the piston or tool to limit a displacement of the piston, wherein the limit switch is usable to control electrical power provided to the piezoelectric pump in response to the piston being displaced to a threshold displacement.

6. The system of claim 1, further comprising one or more additional piezoelectric pumps positionable to cause one or more additional wellbore tools to actuate, wherein the piezoelectric pump and the one or more additional piezoelectric pumps are controllable with a control subsystem to selectively actuate the piezoelectric pump and the one or more additional piezoelectric pumps.

7. The system of claim 6, further comprising the control subsystem, wherein the control subsystem comprises a first type of diode and a second type of diode, wherein the first type of diode or the second type of diode is a silicon diode for alternating current (SIDAC) that is usable to selectively actuate the piezoelectric pump and the one or more additional piezoelectric pumps.

8. The system of claim 1, wherein the piston is encased and magnetically coupled with the wellbore tool to cause the wellbore tool to actuate in response to the piston actuating.

9. The system of claim 1, further comprising:

a piezoelectric stack positionable within the piezoelectric pump; and a pressure compensation system comprising a rubber diaphragm that is couplable with the first hydraulic line to regulate pressure in the system with respect to the wellbore.

10. The system of claim 9, further comprising a pressure balancing line couplable with the first hydraulic line and the piezoelectric pump to pressure-balance the piezoelectric stack.

11. The system of claim 9, further comprising:

one or more accumulators couplable with the first hydraulic line or a second hydraulic line to minimize a pump cycle time of the piezoelectric pump.

12. The system of claim 1, further comprising:

a piezoelectric stack chamber positionable within the piezoelectric pump to house a piezoelectric stack; and a pressure compensation system couplable with the piezoelectric stack chamber to regulate pressure in the piezoelectric stack chamber with respect to the wellbore.

13. The system of claim 1, wherein the set of hydraulic lines comprises:

a first hydraulic line extending from the first side of the piezoelectric pump to the solenoid valve;

a second hydraulic line extending from the solenoid valve to the first side of the piston;

a third hydraulic line extending from the second side of the piston to the solenoid valve; and a fourth hydraulic line extending from the solenoid valve to the second side of the piezoelectric pump.

14. A system comprising:

a piston positionable in a wellbore to control a wellbore tool;

a piezoelectric pump coupled with the piston to generate differential pressure, the piston actuatable in at least a first direction or a second direction in response to receiving the differential pressure in the first direction or the second direction, respectively; and a solenoid valve coupled with the piezoelectric pump and a set of hydraulic lines to selectively cause the piezoelectric pump to apply the differential pressure in the first direction or in the second direction, wherein the solenoid valve comprises an on setting and an off setting, the set of hydraulic lines having a first arrangement and a second arrangement, the first arrangement including a first subset of the set of hydraulic lines extending from a first side of the piezoelectric pump through the solenoid valve to a first side of the piston, and the second arrangement including a second subset of the set of hydraulic lines extending from the first side of the piezoelectric pump through the solenoid valve to a second side of the piston, the solenoid valve having:

the on setting to select a first arrangement of the set of hydraulic lines, the first arrangement including a first subset of the set of hydraulic lines extending from a first side of the piezoelectric pump to a first side of the piston, the first arrangement configured to cause the piezoelectric pump to apply the differential pressure from the first side of the piezoelectric pump to the first side of the piston and to receive return differential pressure from the second side of the piston to a second side of the piezoelectric pump, and the off setting to select a second arrangement of the set of hydraulic lines, the second arrangement including a second subset of the set of hydraulic lines extending from the first side of the piezoelectric pump to the second side of the piston, the second subset different from the first subset, and the second arrangement configured to cause the piezoelectric pump to apply the differential pressure from the first side of the piezoelectric pump to the second side of the piston and to receive return differential pressure from the first side of the piston to the second side of the piezoelectric pump.

15. The system of claim 14, wherein the wellbore tool is an inflow control valve (ICV) that is actuatable to control production of material using the wellbore, and wherein the system further comprises a first hydraulic port corresponding to the first direction and a second hydraulic port corresponding to the second direction.

16. The system of claim 15, wherein the first hydraulic port is coupled with a first side of the piezoelectric pump and a first side of the piston, wherein the second hydraulic port is coupled with a second side of the piezoelectric pump and a second side of the piston, wherein the first side of the piezoelectric pump is different than the second side of the piezoelectric pump, wherein the first side of the piston is different than the second side of the piston.

17. The system of claim 16, wherein the solenoid valve is positioned along the first hydraulic port and the second hydraulic port, and wherein the solenoid valve is usable to switch a direction of the first hydraulic port and the second hydraulic port.

18. The system of claim 14, further comprising one or more additional piezoelectric pumps positionable to cause one or more additional wellbore tools to actuate, wherein the piezoelectric pump and the one or more additional piezoelectric pumps are controllable with a control subsystem to selectively actuate the piezoelectric pump and the one or more additional piezoelectric pumps.

19. The system of claim 18, further comprising the control subsystem, wherein the control subsystem comprises a first type of diode and a second type of diode, and wherein the first type of diode or the second type of diode is a silicon diode for alternating current (SIDAC) that is usable to selectively actuate the piezoelectric pump and the one or more additional piezoelectric pumps.

20. A method comprising:

applying electrical power to a piezoelectric pump to cause the piezoelectric pump to generate differential pressure, the piezoelectric pump positioned in a wellbore;

using a solenoid valve coupled with the piezoelectric pump to select an on setting corresponding with a first direction for the differential pressure or an off setting corresponding with a second direction for the differential pressure, the on setting used to select a first arrangement of a set of hydraulic lines, the first arrangement including a first subset of the set of hydraulic lines extending from a first side of the piezoelectric pump through the solenoid valve to a first side of a piston, the first arrangement causing the piezoelectric pump to apply the differential pressure from the first side of the piezoelectric pump to the first side of the piston and to receive return differential pressure from a second side of the piston to a second side of the piezoelectric pump, the off setting of the solenoid valve used to select a second arrangement of the set of hydraulic lines, the second arrangement including a second subset of the set of hydraulic lines extending from the first side of the piezoelectric pump through the solenoid valve to the second side of the piston, the second subset different from the first subset, the second arrangement causing the piezoelectric pump to apply the differential pressure from the first side of the piezoelectric pump to the second side of the piston and to receive return differential pressure from the first side of the piston to the second side of the piezoelectric pump; and applying the differential pressure on a piston coupled with the piezoelectric pump to displace the piston in the first direction or the second direction to control a wellbore tool positioned in the wellbore, wherein applying the differential pressure includes receiving return differential pressure from a direction opposite the first direction or the second direction.

21. The method of claim 20, wherein the wellbore tool is an inflow control valve (ICV) that is actuated to control production of material using the wellbore, wherein applying the differential pressure comprises applying the differential pressure to a first hydraulic port corresponding to the first direction or to a second hydraulic port corresponding to the second direction.

22. The method of claim 21, wherein the first hydraulic port is coupled with a first side of the piezoelectric pump and a first side of the piston, wherein the second hydraulic port is coupled with a second side of the piezoelectric pump and a second side of the piston, wherein the first side of the piezoelectric pump is different than the second side of the piezoelectric pump, wherein the first side of the piston is different than the second side of the piston, and wherein the solenoid valve is positioned along the first hydraulic port and the second hydraulic port.

23. The method of claim 22, wherein using the solenoid valve comprises:

selecting an on setting of the solenoid valve to select a first arrangement of the first hydraulic port and the second hydraulic port to cause the piezoelectric pump to apply the differential pressure in the first direction; and selecting an off setting of the solenoid valve to select a second arrangement of the first hydraulic port and the second hydraulic port to cause the piezoelectric pump to apply the differential pressure in the second direction.

24. The method of claim 20, further comprising selecting, among a plurality of piezoelectric pumps, the piezoelectric pump or one or more additional piezoelectric pumps to actuate for controlling the wellbore tool or one or more additional wellbore tools.

25. The method of claim 24, wherein selecting the piezoelectric pump or the one or more additional piezoelectric pumps comprises using a control subsystem to select the piezoelectric pump or the one or more additional piezoelectric pumps, wherein the control subsystem comprises a first type of diode and a second type of diode, and wherein the first type of diode or the second type of diode is a silicon diode for alternating current (SIDAC) that is used to select the piezoelectric pump or the one or more additional piezoelectric pumps.

* * * * *